US011813500B2

(12) United States Patent
Aoyama

(10) Patent No.: US 11,813,500 B2
(45) Date of Patent: Nov. 14, 2023

(54) FAN-SHAPED GOLF BALL DIMPLE

(71) Applicant: Acushnet Company, Fairhaven, MA (US)

(72) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/702,070

(22) Filed: Mar. 23, 2022

(65) Prior Publication Data

US 2023/0302328 A1 Sep. 28, 2023

(51) Int. Cl.
*A63B 37/14* (2006.01)
*A63B 37/00* (2006.01)

(52) U.S. Cl.
CPC ..... *A63B 37/0008* (2013.01); *A63B 37/0006* (2013.01)

(58) Field of Classification Search
CPC ..... A63B 37/0007–0012
See application file for complete search history.

(56) References Cited

U.S. PATENT DOCUMENTS 1,656,408 A * 1/1928 Young ..... A63B 37/0073 D21/709
4,389,365 A 6/1983 Kudiavetz
4,869,512 A * 9/1989 Nomura ..... A63B 37/0009 473/383
5,688,191 A 11/1997 Cavallaro et al.
5,713,801 A 2/1998 Aoyama
5,803,831 A 9/1998 Sullivan et al.
5,885,172 A 3/1999 Hebert et al.
5,919,100 A 7/1999 Boehm et al.
5,965,669 A 10/1999 Cavallaro et al.
5,981,654 A 11/1999 Rajagopalan
5,981,658 A 11/1999 Rajagopalan et al.
5,997,418 A * 12/1999 Tavares ..... A63B 37/0007 473/384
6,056,842 A 5/2000 Dalton et al.
6,149,535 A 11/2000 Bissonnette et al.
6,168,407 B1 1/2001 Kasashima et al.
6,231,463 B1 * 5/2001 Tavares ..... A63B 37/0004 473/378
6,358,161 B1 3/2002 Aoyama
6,548,618 B2 4/2003 Sullivan et al.
6,709,349 B2 3/2004 Sullivan
6,824,476 B2 11/2004 Sullivan et al.
6,905,426 B2 6/2005 Morgan et al.
D516,641 S * 3/2006 Lee ..... D21/708
7,887,439 B2 2/2011 Aoyama et al.
8,414,428 B2 4/2013 Aoyama et al.
(Continued)

*Primary Examiner* — Eugene L Kim
*Assistant Examiner* — Matthew B Stanczak
(74) *Attorney, Agent, or Firm* — Steven Landolfi, Jr.

(57) ABSTRACT

Golf balls include dimples for generating a turbulent boundary layer. At least some of the dimples include a fan-shape. The fan-shaped dimple has a plurality of blades. Each blade has a trailing edge flush with a land area of a spherical surface of the golf ball, a leading edge, and a side wall connected to the leading edge. The dimple also has a sloped floor extending from the trailing edge to the leading edge, a blade tip connecting the leading edge to the trailing edge at a distal end of the blade, and a blade root connecting the leading edge to the trailing edge at a proximal end of the blade.

13 Claims, 11 Drawing Sheets

(56) References Cited

U.S. PATENT DOCUMENTS 9,180,344 B2 11/2015 Aoyama
10,010,760 B1 * 7/2018 Crahan ..... A63B 37/0039
10,369,417 B2 8/2019 Nardacci et al.
10,532,251 B1 * 1/2020 Madson ..... A63B 37/0006
10,814,177 B1 * 10/2020 Madson ..... A63B 37/0019
10,814,178 B1 * 10/2020 Crahan ..... A63B 37/0009
2002/0123395 A1 * 9/2002 Murphy ..... A63B 37/0019 473/378
2002/0165044 A1 * 11/2002 Sullivan ..... A63B 37/0009 473/378
2003/0171167 A1 * 9/2003 Kasashima ..... A63B 37/0019 473/378
2005/0009644 A1 * 1/2005 Aoyama ..... A63B 37/0012 473/378
2005/0043119 A1 * 2/2005 Veilleux ..... A63B 37/00065 473/383
2006/0089211 A1 * 4/2006 Sato ..... A63B 37/0012 473/378
2007/0167258 A1 * 7/2007 Sato ..... A63B 37/0012 473/378
2008/0234071 A1 * 9/2008 Sullivan ..... A63B 37/0004 473/383
2010/0216575 A1 * 8/2010 Sato ..... A63B 37/0018 473/383
2010/0304897 A1 * 12/2010 Madson ..... A63B 37/0007 473/383
2011/0028245 A1 * 2/2011 Nakagawa ..... A63B 37/0018 473/378
2011/0098135 A1 * 4/2011 Ono ..... A63B 37/0005 473/383
2013/0085017 A1 * 4/2013 Goodwin ..... A63B 37/0018 473/383
2014/0200099 A1 * 7/2014 Aoyama ..... A63B 37/001 473/383
2016/0184644 A1 * 6/2016 Sato ..... A63B 37/0096 473/383
2016/0271456 A1 * 9/2016 Hwang ..... A63B 37/001
2016/0375311 A1 * 12/2016 Sato ..... A63B 37/0012 473/383
2018/0272193 A1 * 9/2018 Madson ..... A63B 37/002
2019/0168075 A1 * 6/2019 Nardacci ..... A63B 37/0074
2019/0232115 A1 * 8/2019 Madson ..... A63B 37/0005
2019/0299062 A1 * 10/2019 Madson ..... A63B 37/0007
2019/0344124 A1 * 11/2019 Madson ..... A63B 37/0007
2020/0108297 A1 * 4/2020 Madson ..... A63B 37/0018
2020/0139196 A1 * 5/2020 Madson ..... A63B 37/002
2020/0171357 A1 * 6/2020 Madson ..... A63B 37/007
2020/0188738 A1 * 6/2020 Madson ..... A63B 37/0008
2020/0206571 A1 * 7/2020 Madson ..... A63B 37/0018
2020/0276480 A1 * 9/2020 Madson ..... A63B 37/0015
2020/0353317 A1 * 11/2020 Watanabe ..... A63B 37/0087
2020/0398115 A1 * 12/2020 Madson ..... A63B 37/0012
2021/0023420 A1 * 1/2021 Hunt ..... B29C 45/03
2021/0038946 A1 * 2/2021 Nardacci ..... A63B 37/0012
2021/0106877 A1 * 4/2021 Nardacci ..... A63B 37/0006

* cited by examiner

FAN-SHAPED GOLF BALL DIMPLE

FIELD OF THE INVENTION

The present disclosure relates to golf balls, particularly to golf ball dimples. More particularly, the present disclosure relates to fan-shaped golf ball dimples.

BACKGROUND OF THE INVENTION

Golf ball dimples work by inducing turbulence in the boundary layer of the air adjacent to the surface of the golf ball. Compared to laminar boundary layers, turbulent boundary layers are better able to remain attached to the ball surface. Thus, the size of the wake behind the golf ball can be reduced if the boundary layer is turbulent rather than laminar, resulting in a reduction of pressure drag acting on the golf ball. Although turbulent boundary layers generate greater skin friction drag, this is dramatically outweighed by the reduction of pressure drag. However, manufacturers are still dedicated in their efforts to reducing pressure drag and minimize the corresponding increase in skin friction drag to maximize the net benefit. Accordingly, there is a need in the art for improved dimple designs and geometry that induce turbulence in the boundary layer by drawing the air flow into the dimples.

SUMMARY OF THE INVENTION

In some embodiments, the present disclosure includes a golf ball including a generally spherical surface and a plurality of dimples separated by a land area. At least one dimple includes a plurality of blades. Each blade includes a trailing edge flush with the land area of the golf ball, a leading edge, and a side wall connected to the leading edge. The dimple also includes a sloped floor extending from the trailing edge to the leading edge, a blade tip connecting the leading edge to the trailing edge at a distal end of the blade, and a blade root connecting the leading edge to the trailing edge at a proximal end of the blade.

In some embodiments, the present disclosure includes a golf ball comprising a plurality of dimples. At least one of the dimples includes a plurality of asymmetrical blades connected about a dimple center. Each blade comprises a trailing edge, a leading edge, and a side wall connected to the leading edge. The leading edge includes a reflex curvature.

In other embodiments, the present disclosure includes a golf ball including a plurality of dimples. Each of the plurality of dimples includes a plurality of asymmetrical blades connected about a dimple center. Each blade includes a trailing edge, a leading edge, a side wall connected to the leading edge, and a blade tip connecting the leading edge to the trailing edge at a distal end of the blade. The leading edge includes a reflex curvature. The dimples may be arranged on the golf ball such that all of the blade tips are pointed at a neighboring dimple. In another embodiment, the dimples may be arranged on the golf ball such that each blade nests into a recess between adjacent blades of a neighboring dimple. The plurality of dimples may include a first dimple subset and a second dimple subset that comprise a different number of blades than the first dimple subset.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

The present disclosure relates to the shape of a golf ball dimple. In particular, an exemplary golf ball includes a dimple having at least a portion that is in the shape of a fan blade. A dimple according to the present disclosure may include a plan shape including repeating fan blades that form a fan or propeller shape. In at least some embodiments, a center of the dimple includes a blade junction at which all of the fan blade shapes are connected. Similar to a conventional circular dimple, a floor of the fan-shaped dimples may slope toward a center of the dimple, with S-shaped side walls interrupting the slope to produce the fan blade shape. The fan blade and overall fan shape draws air flow into the dimples and induces rotating vortices to increase turbulence in the boundary layer as the golf ball moves through the air.

The shape of the blades that make up each dimple may include vertical side walls that have reflex curvature (also referred to herein as "S-shaped"), similar to the walls of the dimples described in U.S. Pat. No. 9,180,344, the disclosure of which is herein incorporated by reference in its entirety. However, in the dimples of the present disclosure, the walls do not occur in opposing right and left hand pairs; rather, within a given dimple they are arranged in a generally radial fashion with the same handedness. This produces a dimple with the general three-dimensional topography of a fan or propeller, as opposed to a star shape or other geometry having symmetrical arms. Moreover, the repeating sections or "blades" of the dimple are asymmetrical. The S-shaped walls more efficiently generate boundary layer turbulence, which is a typical purpose of any golf ball dimple. As a result, fewer dimples may be used on the surface of the golf ball without sacrificing performance because the disclosed dimples generate turbulence both along their expanded outer perimeter length and internally by the curved side walls.

Figure 1:
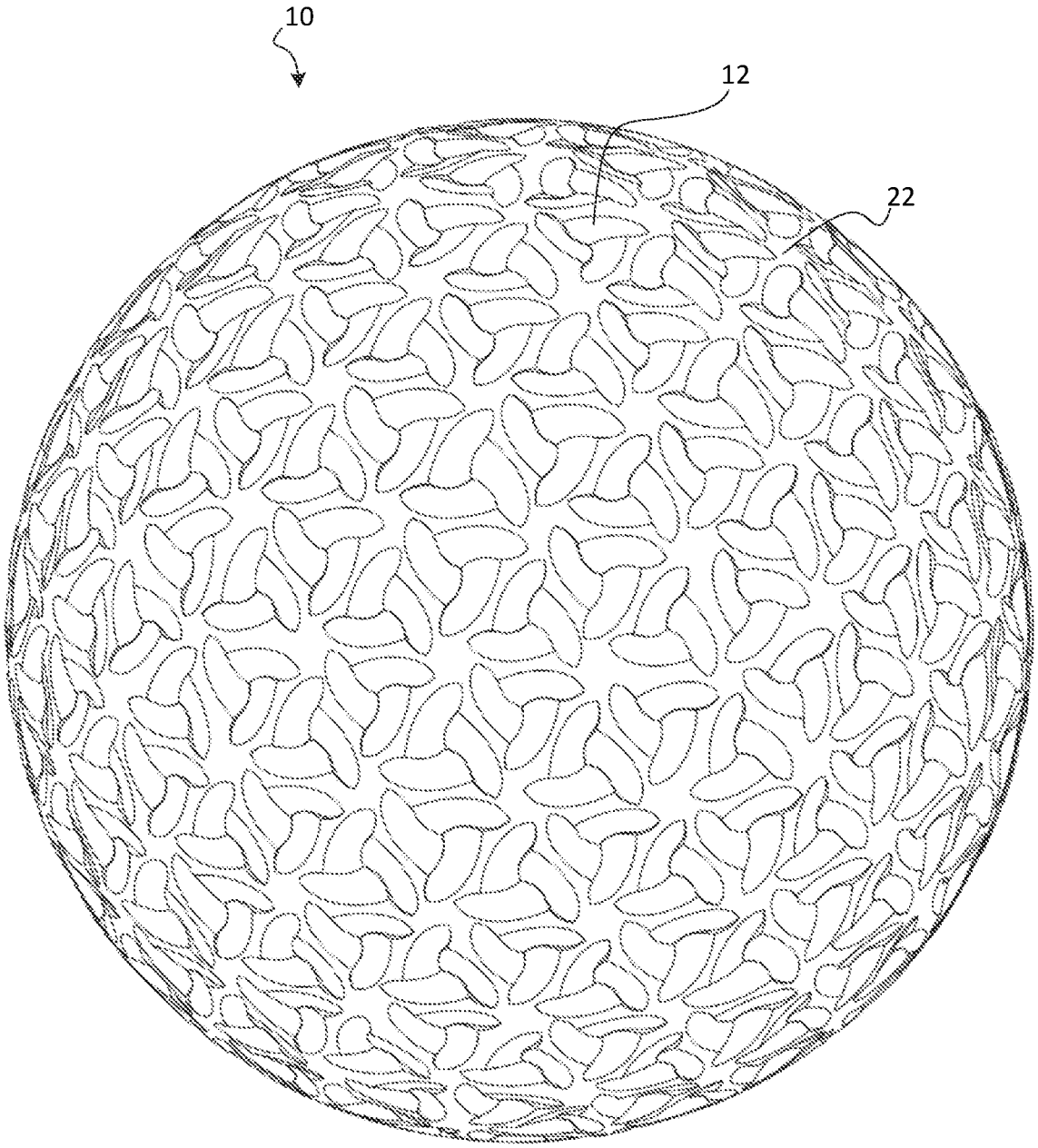
FIG. 1 is a golf ball having fan-shaped dimples.

FIG. 1 is an illustration of a golf ball 10 according to an exemplary embodiment. The golf ball 10 includes a plurality of dimples 12 (in the depicted embodiment, all of the dimples shown on the golf ball 10 are the same or similar and thus are represented by the dimple 12). The dimples 12 are arranged on the generally spherical surface of the golf ball and separated by a land area 22 of the golf ball 10 in a dimple pattern. The dimple pattern is defined by the placement of the dimples 12 on the golf ball 10, including the relative positioning and orientation of the dimples in relation to each other. The dimple pattern includes parameters such as dimple count, surface coverage, dimple spacing, pattern repetition, pattern symmetry, dimple orientation, dimple location, among other characteristics.

Figure 2:
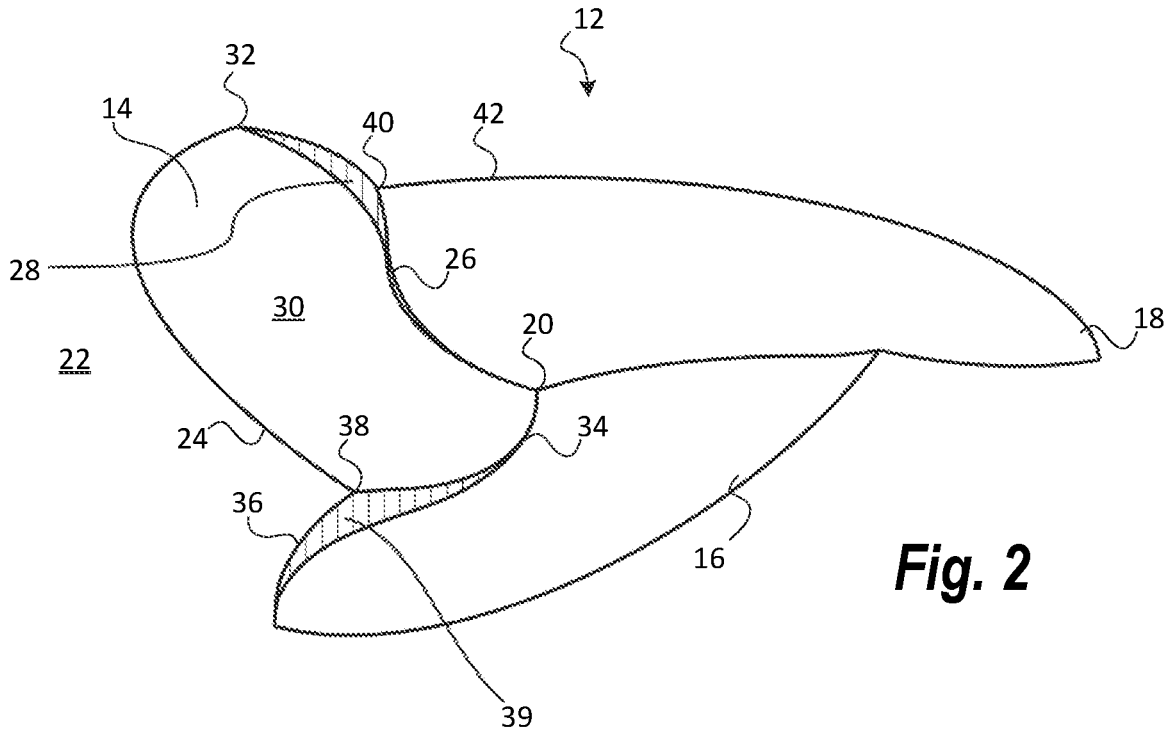
FIG. 2 is a perspective view of an exemplary fan-shaped dimple, consistent with the present disclosure.
Figure 3:
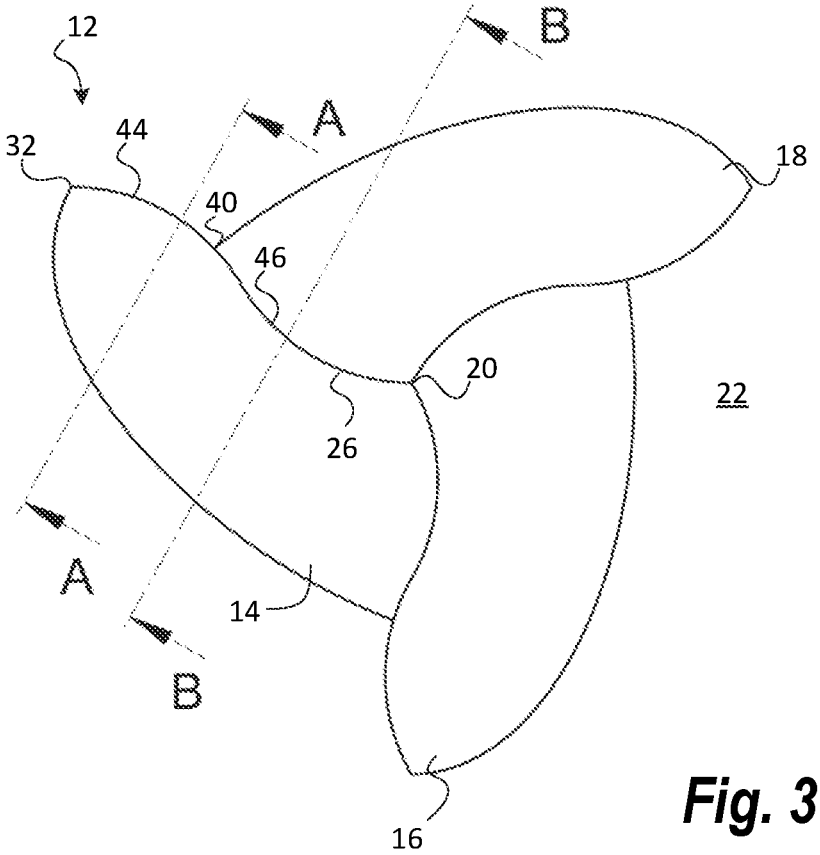
FIG. 3 is a plan view of the fan-shaped dimple of FIG. 2.
Figure 4:
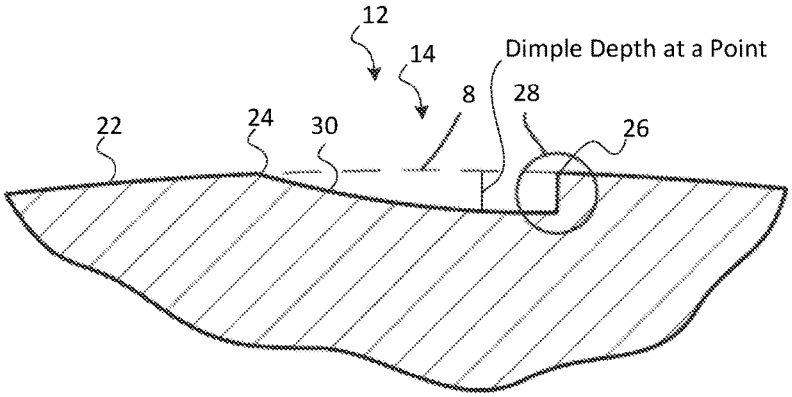
FIG. 4 is a cross-sectional view of a portion of the fan-shaped dimple of FIG. 2, taken along line A-A of FIG. 3.
Figure 5:
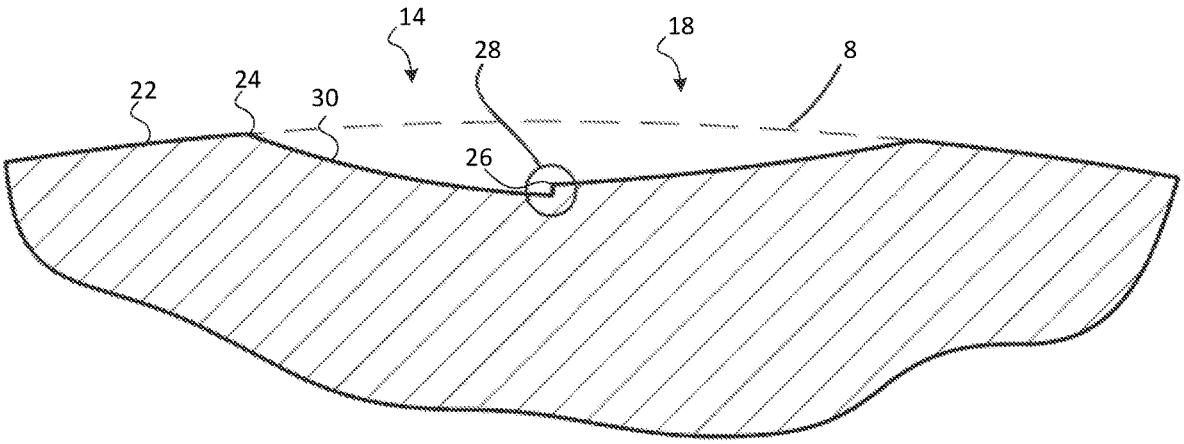
FIG. 5 is a cross-sectional view of another portion of the fan-shaped dimple of FIG. 2, taken along line B-B of FIG. 3.
Figure 6A:
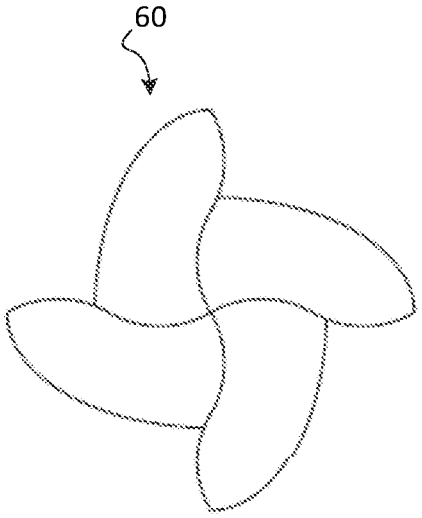
FIG. 6A is a plan view of a fan-shaped dimple having four fan blades, consistent with the present disclosure.
Figure 6B:
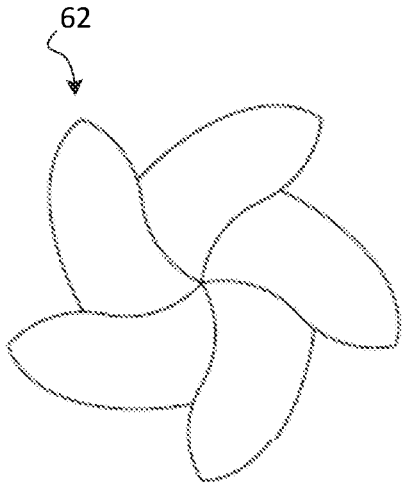
FIG. 6B is a plan view of a fan-shaped dimple having five fan blades, consistent with the present disclosure.
Figure 6C:
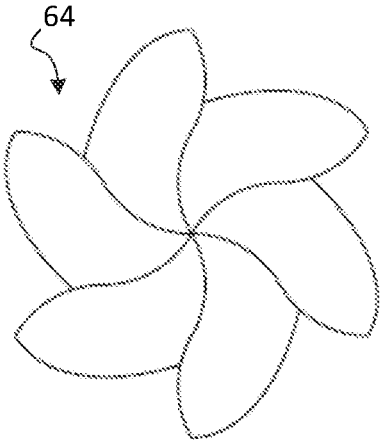
FIG. 6C is a plan view of a fan-shaped dimple having six fan blades, consistent with the present disclosure.
Figure 6D:
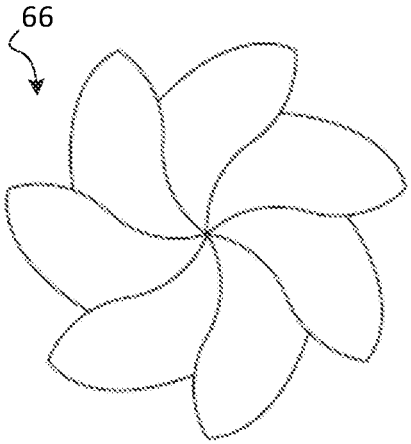
FIG. 6D is a plan view of a fan-shaped dimple having seven fan blades, consistent with the present disclosure.
Figure 6E:
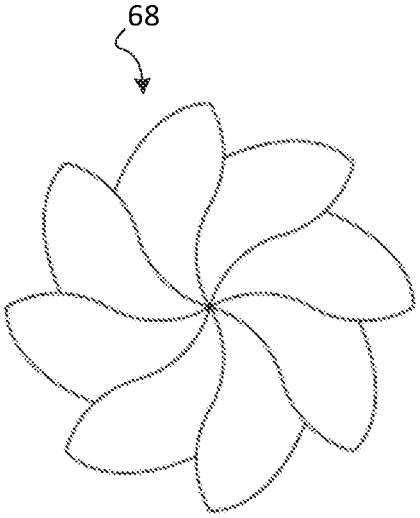
FIG. 6E is a plan view of a fan-shaped dimple having eight fan blades, consistent with the present disclosure.

FIG. 2 is a perspective view of an exemplary one of the dimples 12. FIG. 3 is a top view of the dimple 12. FIG. 4 is a cross sectional view of the dimple 12, taken along line A-A of FIG. 3. FIG. 5 is a cross-sectional view of the dimple 12, taken along line B-B of FIG. 3. The dimple 12 is a composite dimple in the shape of a fan and made up of multiple fan "blades" 14, 16, 18. The blades 14, 16, 18 are connected to each other and offset around a blade junction 20. The blade junction 20 is a point shared by all of the blades 14, 16, 18 that make up the fan shape of the dimple 12. The blade junction 20 may be positioned at a center of the dimple 12 (e.g., the centroid of the dimple as seen in a top view). The blade junction 20 may be a largest depth of the dimple 12 in relation to the land area 22 of the golf ball 10. In this way, the center of the dimple 12 may be the largest depth, similar to conventional dimples.

The three-dimensional topography of the dimple 12 resembles a fan or propeller, in that the blades 14, 16, 18 don't lie flat on the generally spherical surface of the golf ball 10. Rather, they are flush along one edge but depressed along the opposite edge, which ends in a vertical side wall that connects it to the land area 22. Thus, the blade surface has an angle that is analogous to the pitch angle of a fan or propeller blade. Since the side walls are vertical, they are not visible in the plan view of FIG. 3. The cross-sectional views of FIG. 4 and FIG. 5 show the shape of the blade depression more clearly. In FIGS. 4 and 5, a ball phantom surface 8 is shown above the dimple as a continuation of the land area 22 of the golf ball 10. Section A-A taken through the tip area of the blade 14 shows how the surface of the blade descends below the phantom surface 8 of the ball much like a conventional dimple, but ends abruptly at a vertical side wall 28 that returns to the ball surface. Section B-B is taken along a path where two blades abut. In this case, the side wall 28 still exists but is reduced in height because it connects to the abutting blade rather than the ball surface.

Referring to FIGS. 4-5, dimple depth at a given point (as used herein) is the distance measured along a ball radius from the phantom surface 8 to the surface of the golf ball 10 at the given point, regardless of whether the surface is the land area 22 or a surface within the dimple 12. In this way, the land area 22 is at a dimple depth of zero and transition edges from the land area 22 into the dimple 12 are at a dimple depth of substantially zero, with some tolerance for effects of paint. Dimple volume is the space enclosed between the phantom surface 8 and the surface of the dimple.

As mentioned above, the dimple 12 includes a blade 14 that forms a portion of the composite dimple. The following description of the blade 14 can be applied to blades 16, 18, as well. The blade 14 includes a trailing edge 24, a leading edge 26, a side wall 28, a floor 30, a blade tip 32, and a blade root 34. The trailing edge 24 is a transition edge between the land area 22 and the floor 30 of the blade 14. The floor 30 slopes away from the trailing edge 24 toward the blade junction 20. The trailing edge 24 is thus flush with the land area 22 and therefore has a depth of substantially zero. The floor 30 extends from the trailing edge 24 to the leading edge 26 and is directly connected to the land area 22 by the trailing edge 24. The leading edge 26 is positioned opposite from the trailing edge 24. The blade tip 32 connects the leading edge 26 to the trailing edge 24 at a distal end of the blade 14. The blade root 34 connects the leading edge 26 to the trailing edge at a proximal end of the blade 14. As used herein, "distal" means further from the center of the dimple and "proximal" means closer to the center of the dimple.

In an exemplary embodiment, the trailing edge 24 has a single curvature (e.g., the edge is convex or concave along its entire length and thus does not include both a convex and a concave portion). In disclosed embodiments, the leading edges and corresponding side walls, including the leading edge 26 and the side wall 28, have a reflex curvature, or S-Shape (e.g., the edge includes both a concave and convex portion) in order to more efficiently induce turbulent air flow. As a result, each blade 14, 16, 18 is asymmetrical. For example, the blades 14, 16, 18 are asymmetrical in a plan view, as shown in FIG. 3. In some alternative embodiments, the leading edges and side walls may be straight when viewed from above.

In a mathematical sense, the term "reflex curvature" refers to a curve in which the second derivative changes sign from positive to negative or vice-versa. A positive second derivative means the curve is "concave-up", while a negative second derivative means it is "concave-down". Thus, a shape with reflex curvature is concave-up in a first portion and changes to concave-down in a second portion, or vice-versa. The point at which the transition occurs (i.e., the second derivative is either zero or undefined) is called the "inflection point."

The leading edge 26 of the blade 14 is connected to the floor 30 by the side wall 28 (e.g., the leading edge 26 is the top edge of the side wall 28). In an exemplary embodiment, the disclosed side walls, including the side wall 28, are vertical (perpendicular to the land area 22 of the golf ball 10) or near vertical, which is also a feature for enhancing the aerodynamic effect of the disclosed dimples. For example, the side wall 28 forms an angle of about 90 degrees with the land area 22.

In at least some embodiments, the blade root of a blade is an edge that extends from the base end of the trailing edge to the base end of the leading edge, where the base ends of all of the leading edges are connected at the blade junction. As a result, the blade root slopes from the trailing edge directly to the blade junction (i.e., the blade root slopes from a smallest depth at the trailing edge to a largest depth at the blade junction). In the example of the blade 14, the blade root 34 slopes from the trailing edge 24 to the blade junction 20, which is also the base end of the leading edge 26. In an exemplary embodiment, the blade root of one blade overlaps a portion of the leading edge of an adjacent blade. For example, the blade root 34 overlaps the leading edge 36 of the blade 16. The point at which the trailing edge 24 intersects the leading edge 36 is a first connection point 38 (which is also the base end of the trailing edge 24. The leading edge 36 of the blade 16 drops off to a side wall 39, similar to the leading edge 26 and side wall 28.

The blade 14 includes a second connection point 40, similar to the first connection point 38, at an intersection between the leading edge 26 of the blade 14 and the trailing edge 42 of the blade 18 (i.e., the base end of the trailing edge 42). The second connection point 40 divides the leading edge 26 into a first portion 44 and a second portion 46 (shown in FIG. 3). The first portion 44 extends along the leading edge 26 from the blade tip 32 (i.e., the distal end of the leading edge 26) to the connection point 40. The second portion 46 extends along the leading edge 26 from the connection point 40 to the blade junction 20 (i.e., the base end of the leading edge 26). The first portion 44 of the leading edge 26 is flush with the land area 22 of the golf ball and thus has a depth of substantially zero. The second portion 46, which overlaps the blade root of the adjacent blade 18, slopes from the land area 22 to the blade junction 20. The side wall 28, which is connected to the leading edge 26, has a height of substantially zero at the blade tip 32 and increases in height along the first portion 44 of the leading edge 26 (as the depth of the floor 30 increases while the depth of the leading edge 26 stays the same) and reaches a largest height at the connection point 40. The side wall 28 decreases in height from the connection point 40 to the blade junction 20 (as the depth of the floor 30 increases at a slower rate than the depth of the leading edge 26), where the side wall 28 reaches the floor 30 and again has a height of substantially zero. All of the side walls of the blades 14, 16, 18 meet at the blade junction 20 and reach a height of zero, thus creating a shared point of largest depth of the dimple 12 at the dimple center.

There are various parameters of the disclosed fan-shaped dimples that can be adjusted to produce different dimple configurations with varying appearance and characteristics. For example, edge length, edge and wall curvature, floor slope, dimple depth, among other parameters, may be adjusted. In addition, although the dimple 12 has three fan blades, any desired number may be used. For example, the number of blades bay be in a range from 3-8. FIGS. 6A, 6B, 6C, 6D, 6E show examples of fan-shaped dimples 60, 62, 64, 66, 68 having four, five, six, seven, and eight blades, respectively.

Figure 7A:
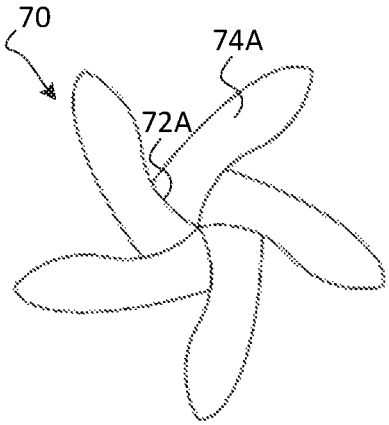
FIG. 7A is a plan view of a fan-shaped dimple having narrow blades, consistent with disclosed embodiments.
Figure 7B:
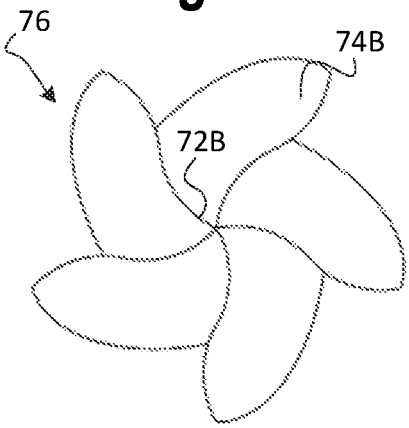
FIG. 7B is a plan view of a fan-shaped dimple having blades with an intermediate width, consistent with disclosed embodiments.
Figure 7C:
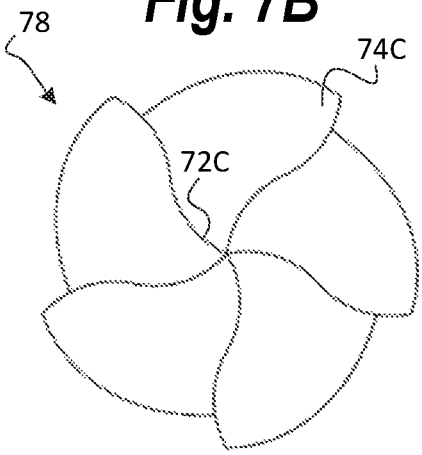
FIG. 7C is a plan view of a fan-shaped dimple having wide blades, consistent with disclosed embodiments.

In another example, the blades of a fan-shaped dimple may vary in width. For instance, the length of the blade root of each blade may be adjusted, thereby changing the width of the blade. FIG. 7A includes an example of a dimple 70 having a relatively short blade root 72A, thereby producing a narrow blade 74A, similar to that found in an airplane propeller. FIG. 7B includes a dimple 76 having an intermediate-width blade 74B and corresponding blade root 72B. FIG. 7C includes a dimple 78 having a relatively long blade root 72C thereby producing a wide blade 74C, similar to that found in a ship propeller. In some embodiments, blades of varying width may be used in the same dimple. Due to the configuration of each blade, blade width can be characterized as a ratio of a length of the blade root to a length of the leading edge, hereinafter referred to as blade width ratio. In exemplary embodiments, the relevant lengths are the actual curve lengths. However, straight line lengths may also be used in some instances to characterize the relative size of a blade. In embodiments in which each of the blades are the same size, the blade width ratio is in the range between 0 and 1. In FIGS. 7A-7C, the relative blade width ratio of the dimples 70 (blade width ratio "A"), 76 (blade width ratio "B"), 78 (blade width ratio "C") is $0<A<B<C<1$. When all of the blades are the same size, the width of a blade can be characterized by the connection point between trailing edge of one blade and the leading edge of an adjacent blade. For example, the connection point may occur at a midpoint of the leading edge, thereby producing an intermediate-width blade. In the dimple 70, the connection point is proximal of the midpoint of the leading edge, thereby producing a narrow blade. In the dimple 76, the connection point is near or slightly distal of the midpoint of the leading edge, thereby producing an intermediate-width blade. In the dimple 78, the connection point is distal of the midpoint of the leading edge, producing a wide blade.

Figure 8A:
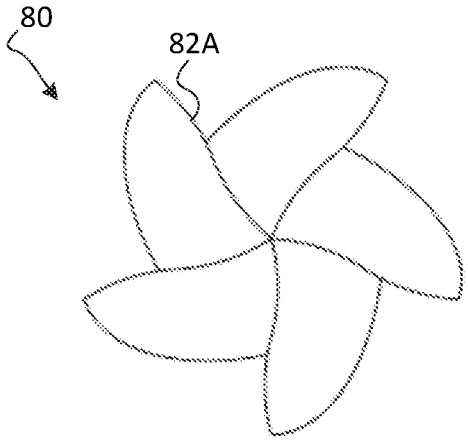
FIG. 8A is a plan view of a fan-shaped dimple having blades with a small reflex curvature, consistent with disclosed embodiments.
Figure 8B:
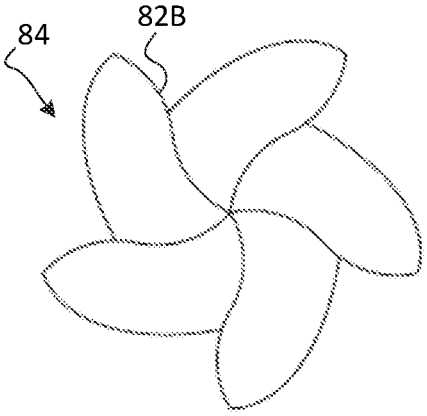
FIG. 8B is a plan view of a fan-shaped dimple having blades with an intermediate reflex curvature, consistent with disclosed embodiments.
Figure 8C:
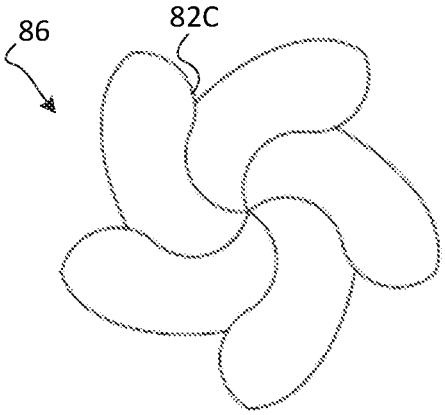
FIG. 8C is a plan view of a fan-shaped dimple having blades with a large reflex curvature, consistent with disclosed embodiments.

In another example, the reflex curvature of the leading edge of the blades may vary in severity. The following description of leading edge curvature may also apply to side wall curvature, as the leading edge is an edge of the side wall. FIG. 8A includes an example of a dimple 80 with nearly straight leading edges 82A. FIG. 8B includes an example of a dimple 84 with leading edges 82B having an intermediate amount of curvature. FIG. 8C includes an example of a dimple 86 with leading edges 82C that are sharply curved. Blades of varying curvature may be used in the same dimple if desired. The curvature of the leading edges may be characterized by a radius of curvature for the concave sections, a line or wave equation, and/or a ratio of a straight line distance between the ends of the leading edge and an actual length of the leading edge.

Figure 9A:
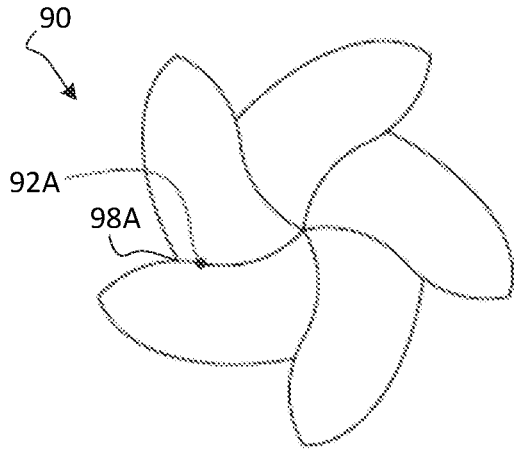
FIG. 9A is a plan view of a fan-shaped dimple having blades with an intermediate inflection point, consistent with disclosed embodiments.
Figure 9B:
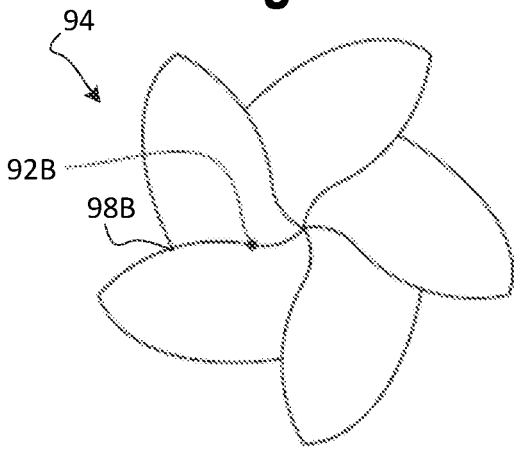
FIG. 9B is a plan view of a fan-shaped dimple having blades with a proximal inflection point, consistent with disclosed embodiments.
Figure 9C:
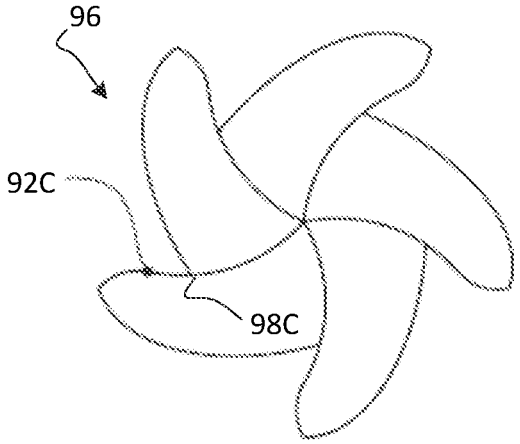
FIG. 9C is a plan view of a fan-shaped dimple having blades with a distal inflection point, consistent with disclosed embodiments.

In some embodiments, the inflection point of the leading edge reflex curvature is located at the midpoint of the leading edge, such as in the dimple 12. FIG. 9A also shows an example of a dimple 90 having an inflection point 92A at the midpoint of leading edge. However, the inflection point may be moved closer to the center of the dimple or closer to the tip of the blade, as desired. FIG. 9B shows an example of a dimple 94 with the inflection point 92B closer to the center of the dimple (proximal of the midpoint), while FIG. 9C includes an example of a dimple 96 having an inflection point 92C closer to the tip of the blade (distal of the midpoint). Blades with varying inflection point position may be used in the same dimple if desired. The location of the inflection point of the leading edge can also be related to the width of the blade by comparing the inflection point of a leading edge to the connection point between the leading edge and the trailing edge of an adjacent blade. For example, the inflection points 92A, 92B are proximal of the connection points 98A, 98B, respectively, while the inflection point 92C is distal of the connection point 98C.

Fan shaped dimples may be arranged into a pattern on the surface of the ball using any desired method or scheme. As is well known in the art, the surface is usually divided into spherical polygonal areas corresponding to the faces of a regular or semi-regular polyhedron, often an icosahedron, an octahedron, a dodecahedron, an icosidodecahedron, or a cuboctahedron, and similar areas are filled with similar arrangements of dimples. With conventional circular dimples, the rotational orientation of each dimple within the pattern is irrelevant. However, fan shaped dimples have more complex outer perimeters, so different rotational orientations will produce different spatial relationships with neighboring dimples. While one of ordinary skill in the art will appreciate that the disclosed fan-shaped dimples may be placed on the golf ball using any number of desired patterns or schemes known in the art, dimple patterns based on the geometry of an icosahedron are particularly suitable due the regularity of the dimple arrays produced.

As mentioned above, the disclosed fan-shaped dimples may be arranged on the entire surface of the golf ball or portions thereof. In one embodiment, a plurality of dimples is arranged in a defined space such that the resulting dimple pattern includes at least one fan-shaped dimple. The at least one fan-shaped dimple may be placed randomly on the designated surface or may be selected and arranged by any means known to those skilled in the art. In another embodiment, the plurality of dimples is arranged such that the resulting dimple pattern includes a plurality of disclosed fan-shaped dimples where each dimple shape may be the same or different. In yet another embodiment, the plurality of dimples is arranged such that the resulting dimple pattern includes a plurality of disclosed fan-shaped dimples and a plurality of dimples having a different shape.

Generally, fan-shaped dimples consistent with the disclosure may be characterized as having a size and a shape. The size of a fan-shaped dimple, as used herein, refers to a size of a smallest circle that circumscribes an entirety of the fan-shaped dimple (e.g., the size may be the diameter of the circumscribing circle). The shape of a fan-shaped dimple, as used herein, refers to all other characteristics of the dimple, such as the number of blades, blade width, edge dimensions, dimple depths, etc. Two fan-shaped dimples may have the same size and shape, the same size and a different shape, different sizes and the same shape, or different sizes and shapes.

In some embodiments, a dimple pattern may include a first plurality (e.g., first subset) of disclosed fan-shaped dimples having a first shape and a first size and at least a second plurality (e.g., second subset) of disclosed fan-shaped dimples having a second shape and/or a second size that is different than the first shape and/or the first size (i.e., at least one of the size and shape differ). For example, a subset of a plurality of 3-bladed fan-shaped dimples may be combined with a subset of a plurality of 4-bladed fan-shaped dimples. In another example, a subset of relatively large 5-bladed fan-shaped dimples may be combined with a subset of relatively small 5-bladed fan-shaped dimples. Further examples of these embodiments will be described in more detail.

Likewise, portions of the golf ball surface may be configured with dimples that are not shaped according to the methods described herein. For instance, the location and size of dimples on a golf ball corresponding to a vent pin or retractable pin for an injection mold may be selected in order to avoid significant retooling of molding equipment. Maintaining the selected size and position of such dimples may be accomplished by defining the portions of the ball where dimples will be arranged according to the methods described herein so that the defined portion of the ball surface excludes the dimples that are to remain in their selected position.

Some embodiments may include fan-shaped dimples and "other" types of dimples. The other type of dimple may be a conventional shape (such as a circular plane shape) or a non-circular shape such as oval, triangular, rhombic, rectangular, pentagonal, and polygonal. In one embodiment, the dimple pattern includes a plurality of disclosed fan-shaped dimples and a plurality of at least one other type of dimple placed in remaining portions or undefined spaces in any manner. For example, in one embodiment, the golf ball surface may include a first plurality of disclosed fan-shaped dimples having a first shape and a first size and a second plurality of dimples having a second shape and a second size. In another embodiment, the golf ball surface may include a first plurality of disclosed fan-shaped dimples having a first shape and a first size, a second plurality of disclosed fan-shaped dimples having a second shape and a second size, and a third plurality of dimples having a third shape and a third size.

In another embodiment, the dimple pattern includes a plurality of disclosed fan-shaped dimples and a plurality of at least two other types of dimples placed in remaining portions or undefined spaces in any manner, where the types of other dimples may be defined by different sizes of the same shape of dimple or different shapes in substantially similar or different sizes. For example, in one embodiment, the golf ball surface may include a first plurality of disclosed fan-shaped dimples having a first shape and a first size, a second plurality of dimples having a second shape and a second size, and a third plurality of dimples having a third shape and third size. In this aspect, the second and third shapes may be substantially the same or different. Likewise, the second and third sizes may be substantially the same or different. In one embodiment, the second shape is a circular plane shape and the third shape is a non-circular shape. In another embodiment, the second and third shapes may each be circular plane shapes where the second size is greater than the third size.

In another embodiment, the golf ball surface may include a first plurality of disclosed fan-shaped dimples having a first shape and a first size, a second plurality of disclosed fan-shaped dimples having a second shape and a second size, and at least a third plurality of dimples having a third shape and a third size, with the option to have additional pluralities of dimples having different shapes and/or sizes from the third plurality of dimples. In this aspect, the additional pluralities may have the same shape as the third shape, but a different size than the third size. In the alternative, the additional pluralities may have substantially the same size, but a different shape than the third shape. In addition, the additional pluralities may have a different shape and size than the third shape and size (and also different from each plurality's shape and size).

Several additional non-limiting examples of dimple sizes and shapes that may be used as the "other types of dimples" in the dimple patterns disclosed herein are provided in U.S. Pat. Nos. 6,358,161 and 6,709,349, the entire disclosures of which are incorporated by reference herein.

In addition to varying the perimeter and size of the "other types of dimples," the cross-sectional profile of such dimples may also be varied. For example, in one embodiment, the profile of the dimples corresponds to a catenary curve. This embodiment is described in further detail in U.S. Pat. No. 7,887,439, which is incorporated by reference herein in its entirety. Another example of a cross-sectional dimple profile that may be used with the present disclosure is described in U.S. Pat. No. 6,905,426, which also is incorporated by reference herein in its entirety. Other dimple profiles, such as circular arc, ellipsoidal, or parabolic, may be used as well without departing from the spirit and scope of the present disclosure. In addition, the dimples may have a convex or concave profile, or any combination thereof.

Figure 10:
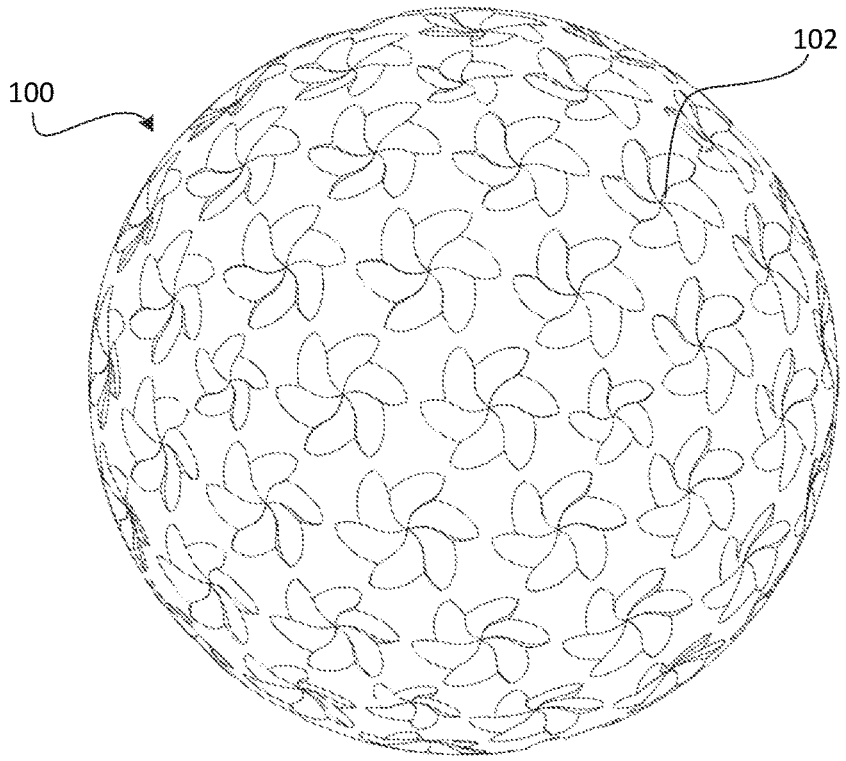
FIG. 10 is a golf ball having fan-shaped dimples according to another embodiment.
Figure 11:
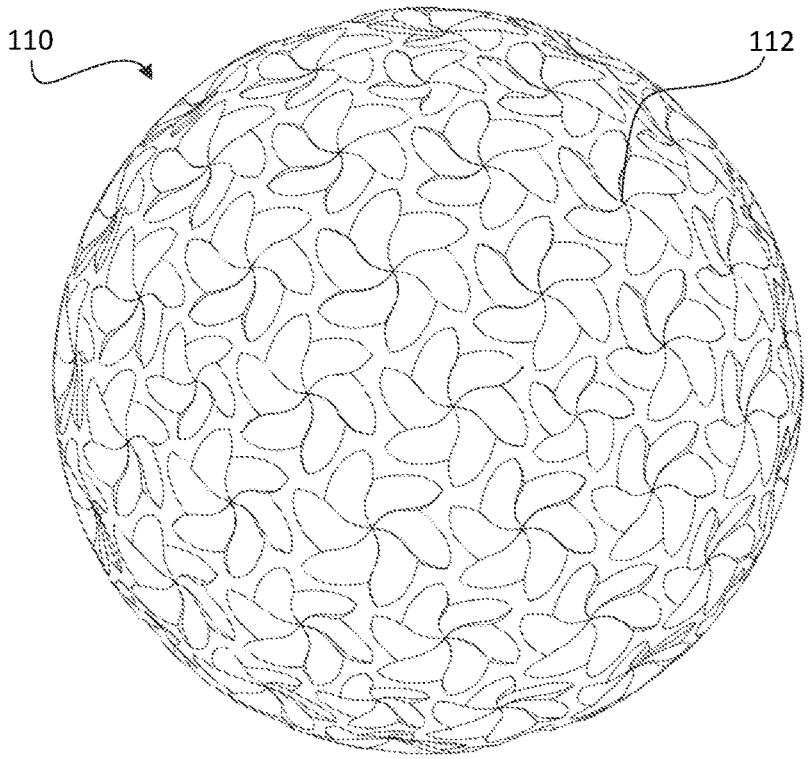
FIG. 11 is a golf ball having fan-shaped dimples according to another embodiment.
Figure 12:
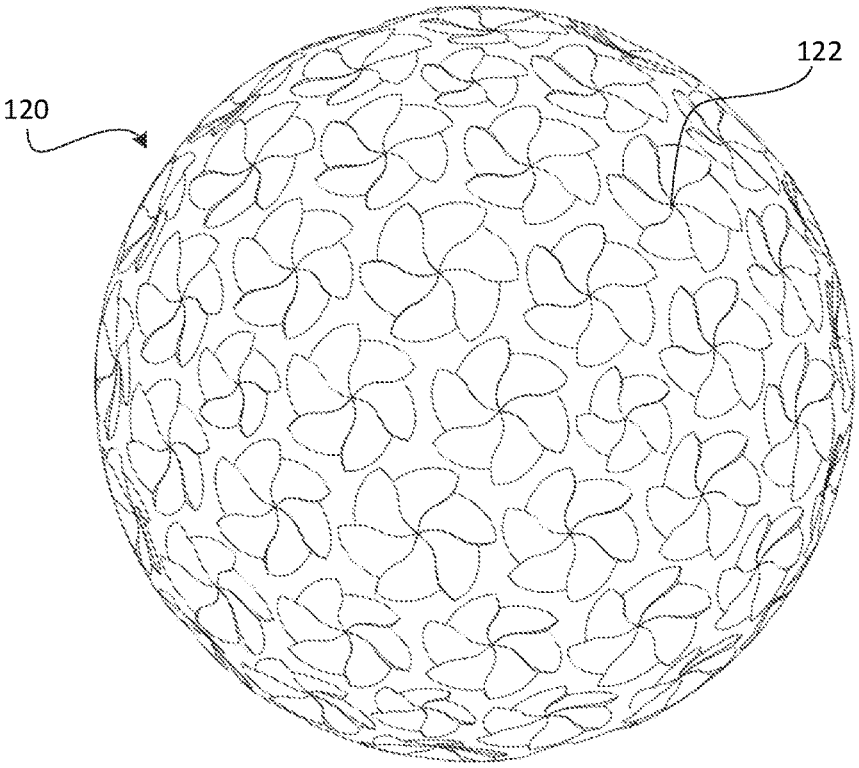
FIG. 12 is a golf ball having fan-shaped dimples according to another embodiment.

FIG. 10 illustrates a golf ball 100 having dimples 102. FIG. 11 shows a golf ball 110 having dimples 112. FIG. 12 shows a golf ball 120 having dimples 122. FIGS. 10, 11, and 12 show dimple patterns based on fundamentally similar icosahedron-based layouts of 92 dimples (80 with six blades and 12 with five blades). In all three embodiments, the dimple pattern has fan-shaped dimples that have an equal number of blades as they have neighboring dimples. However, the patterns appear different because of different positioning and rotational orientations of the dimples 102, 112, respectively. In FIG. 10, each dimple 102 is rotated so that the tips of its blades are pointed at each of its neighbors. For example, for each dimple 102, each blade tip lies approximately along a great circle arc connecting the dimple's center to the center of a neighboring dimple. To avoid intersecting one another, the sizes of the dimples must be relatively small, resulting in a relatively large land area. In contrast, the balls 110, 120 shown in FIGS. 11-12 has each dimple 112, 122 rotated so that the tip of each blade nests into the recess between adjacent blades of each of its neighbors. This allows the dimples to be much larger without intersecting, resulting in a "tiled" appearance with much less land area. The ball 120 has a different appearance from the ball 110 due to the blades being much wider in the dimples 122 than in the dimples 112.

Figure 13:
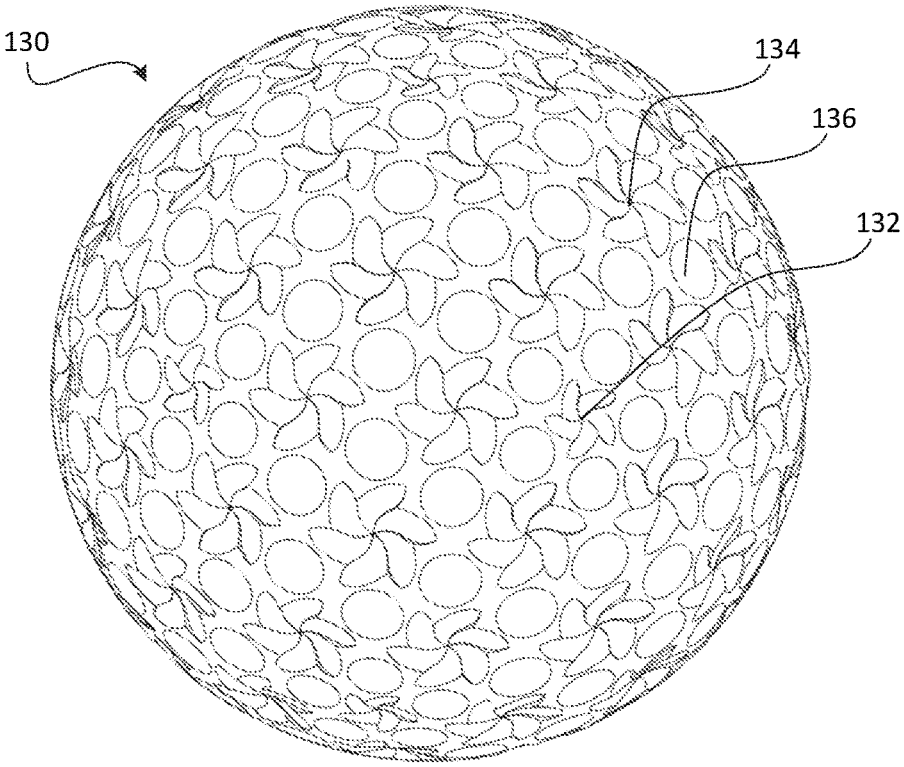
FIG. 13 is a golf ball having fan-shaped dimples according to another embodiment.

In some embodiments, fan-shaped dimples may be mixed with other types of dimples on the surface of a golf ball. FIG. 13 shows a golf ball 130. The golf ball 130 uses an icosahedron-based pattern that results from combining 12 five-bladed fan shaped dimples 132, 80 six-bladed fan shaped dimples 134, and 180 circular dimples 136, for a total of 272.

Figure 14:
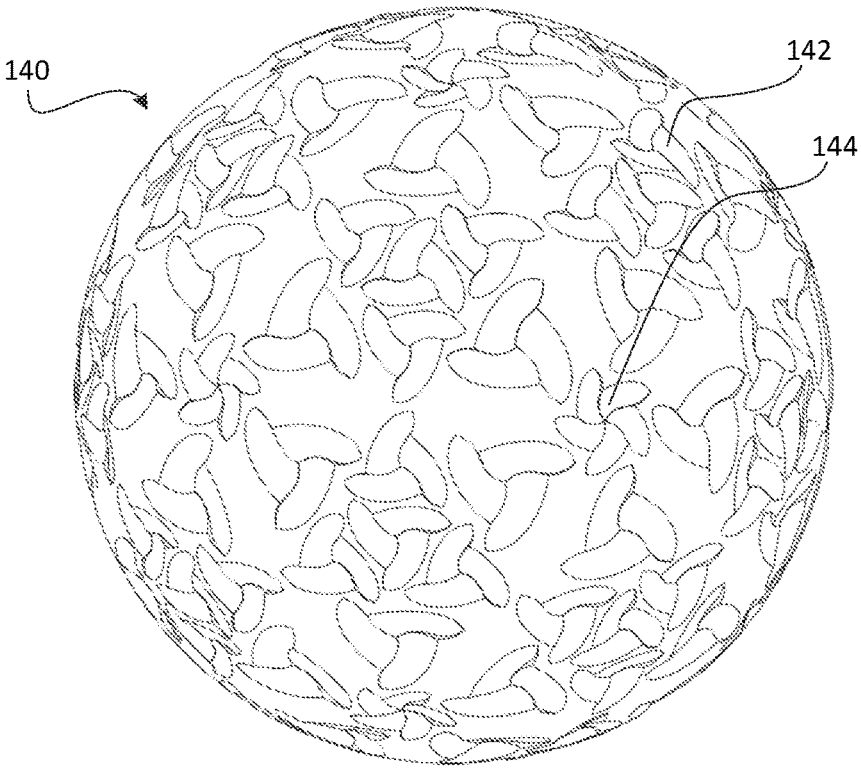
FIG. 14 is a golf ball having fan-shaped dimples according to another embodiment.

FIG. 14 is a golf ball 140 with a dimple pattern that uses different fan-shaped dimples, where at least some of the dimples have two or more additional blades in comparison to other dimples. For example, the golf ball 140 shows an arrangement using a total of 152 fan-shaped dimples, including some three-blade dimples 142 and some five-blade dimples 144.

Figure 15:
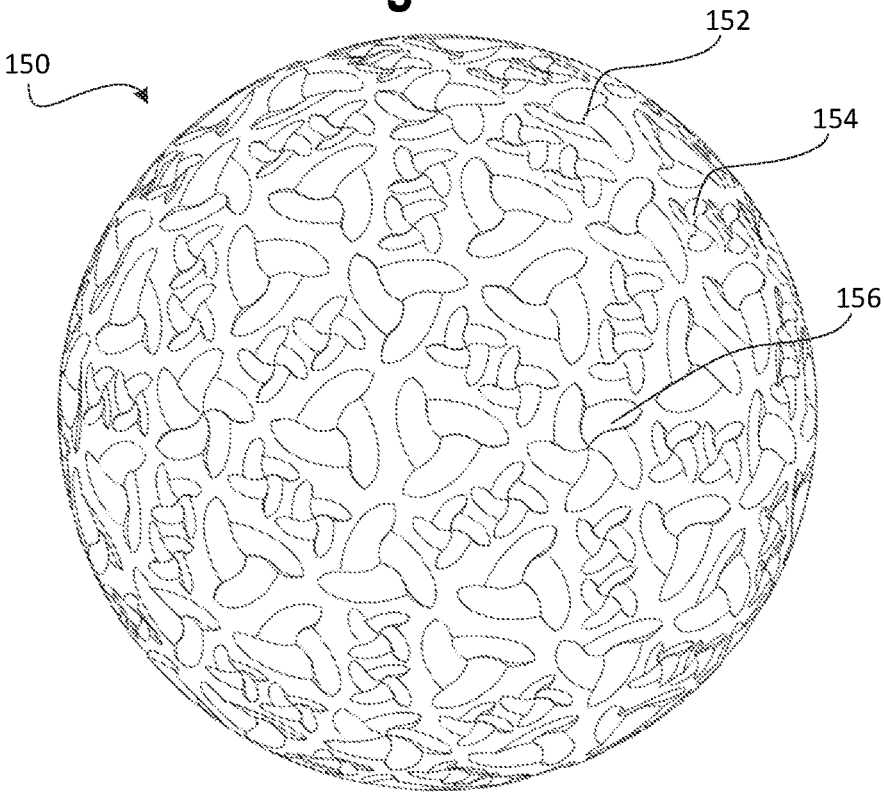
FIG. 15 is a golf ball having fan-shaped dimples according to another embodiment.

In some embodiments, a dimple pattern may include at least three different fan-shaped dimples. For example, FIG. 15 shows yet another arrangement on a golf ball 150. The golf ball 150 has 212 fan-shaped dimples including three-blade dimples 152, four-blade dimples 154, and five-blade dimples 156.

Among the disclosed examples of dimple patterns having only fan-shaped dimples, the dimple counts have ranged from 92 to 212. This number of dimples is low compared to typical patterns of conventional dimples which usually incorporate from about 250 to about 500 dimples. However, the unique architecture of the fan-shaped dimples allows them to generate the necessary boundary layer turbulence with fewer dimples. Conventional dimples generate turbulence primarily along the circular edge that forms their outer perimeter. With fan shaped dimples, not only is the outer perimeter length greater because of the more complex shape, but the internally-located S-shaped side walls also serve as turbulence generators. Thus, fewer dimples are necessary to produce similar aerodynamic performance.

Figure 16:
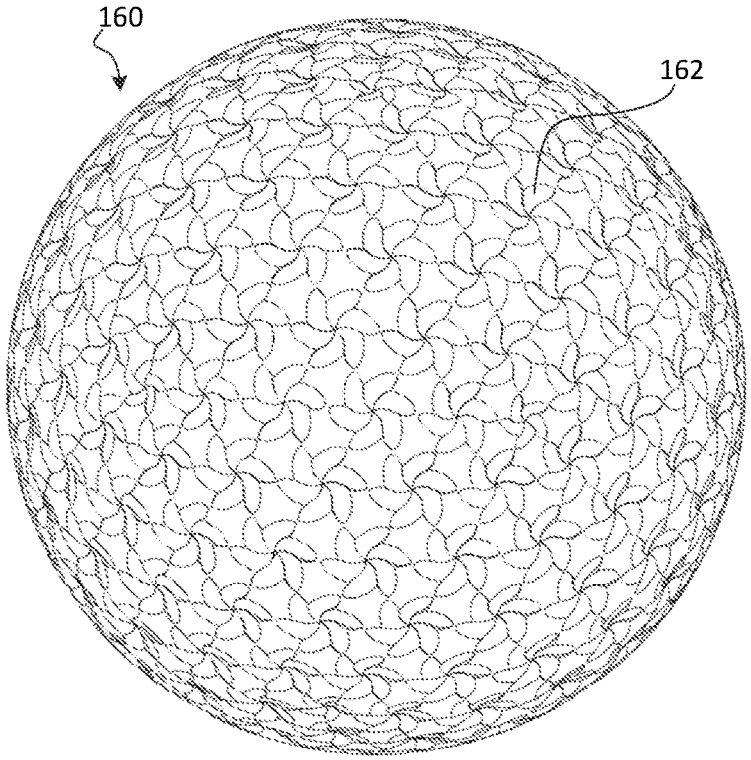
FIG. 16 is a golf ball having fan-shaped dimples according to another embodiment.
Figure 17:
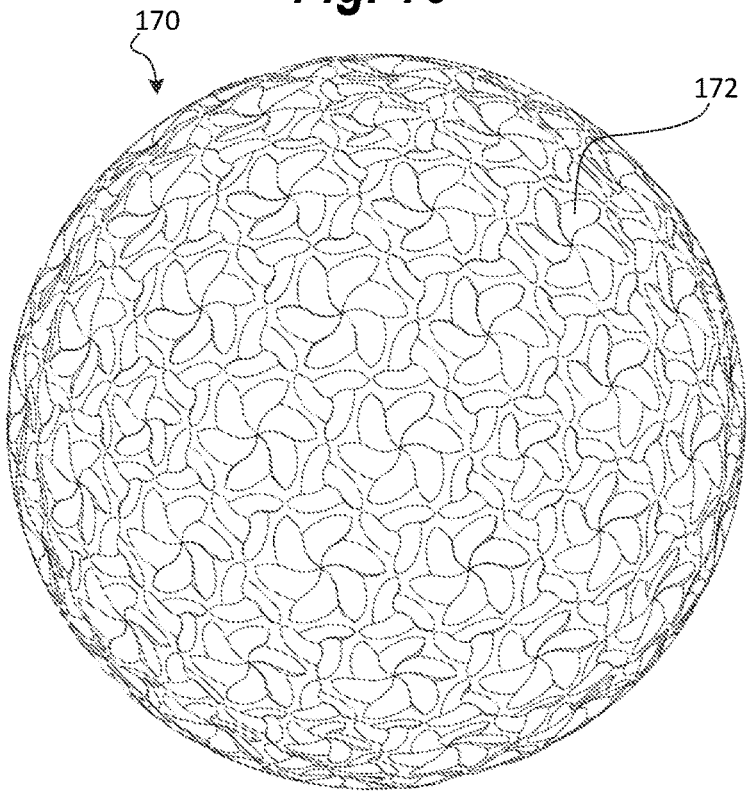
FIG. 17 is a golf ball having fan-shaped dimples according to another embodiment.

Nevertheless, conventional dimple counts may be used if desired. Returning to FIG. 1, the golf ball 10 includes 320 fan-shaped dimples 12. FIG. 16 includes a golf ball 160 having dimples 162. FIG. 17 includes a golf ball 170 having dimples 172. The golf ball 160 includes a dimple pattern having 252 fan-shaped dimples 162, including five- and six-bladed dimples. The golf ball 170 includes a dimple pattern having 272 fan-shaped dimples, including three-, five- and six-bladed dimples.

The defined space for arranging the disclosed fan-shaped dimples on the surface of the ball may approximately correspond to a hemispherical portion of the golf ball, although smaller or larger regions also may be selected. Defining the space in this manner may have particular benefits when the mold that forms the cover is composed of two hemispherical halves.

The defined space may be selected to correspond approximately to the area formed by one mold cavity. In this situation, a boundary region may be imposed near the parting line of the mold so that the dimples are not formed too close to where the mold cavities meet. For instance, a boundary region may be imposed so that no portion of a dimple (composite or other type of dimple) is formed within 0.005 inches or less of the mold parting line. In an exemplary embodiment, this boundary region would be approximately the same distance from the parting line on the corresponding mold cavity.

This technique for defining the space to correspond to a mold cavity may be used even if the corresponding cavities of a pair do not have the same dimensions or configurations. For instance, the parting line of the mold may be offset, as described for instance in U.S. Pat. No. 4,389,365 to Kudriavetz, the disclosure of which is incorporated by reference in its entirety. Additionally, the parting line of the mold may not occur in a single plane, as described for example in U.S. Pat. No. 8,414,428, which is incorporated herein by reference. Other molds may have dimples that cross the parting line such described in U.S. Pat. No. 6,168,407, which is incorporated by reference in its entirety. It is not necessary, however, that the defined space is limited to the area formed by a single mold cavity. Often, the defined space is a smaller spherical polygonal area corresponding to a face of an inscribed polyhedron, as is well known in the art.

The present disclosure is not limited to any particular ball construction, nor is it restricted by the materials used to form the cover or any other portion of the golf ball. Thus, the disclosed dimples may be used with golf balls having solid, liquid, or hollow centers, any number of intermediate layers and any number of covers. It also may be used with wound golf balls, golf balls having multilayer cores, and the like. For instance, the present disclosure may be applied to a golf ball having a double cover, a dual core, and combinations thereof.

Other non-limiting examples of suitable types of ball constructions that may be used with the present disclosure include those described in U.S. Pat. Nos. 6,056,842, 6,824,476, 6,548,618, 5,688,191, 5,713,801, 5,803,831, 5,885,172, 5,919,100, 5,965,669, 5,981,654, 5,981,658, and 6,149,535. The entire disclosures of these patents and published applications are incorporated by reference herein.

As mentioned, golf ball dimples are generally intended to introduce turbulence into the boundary layer, artificially causing air flow around the golf ball to transition into a turbulent state. The turbulent boundary layer is better able remain attached to the ball's surface, which reduces the size of the wake behind the ball and reduces the aerodynamic pressure drag. A conventional circular dimple may introduce turbulence by creating a horseshoe vortex along its leading and lateral edges triggered by air spilling into the dimple. Like the horseshoe vortex generated by an airplane wing, the dimple's vortex leaves oppositely rotating "tails" trailing aft. NACA ducts (named for the developer—the National Advisory Committee for Aeronautics) more efficiently induce a turbulent boundary layer by using diverging S-shaped walls (one right handed and one left handed) to create a similar pair of oppositely rotating trailing vortices. Disclosed embodiments incorporate this characteristic of an S-shaped wall to more efficiently control air flow and introduce turbulence into the boundary layer.

For the case of a fan-shaped dimple of the present disclosure, all of the S-shaped walls may have the same handedness, so if more than one is in a position to create a vortex, all of the vortices will be rotating in the same direction. When the vortices are rotating in the same direction, the turbulent effect is enhanced, where oppositely rotating vortices may cancel each other out where the dimples are small and the edges of the dimple are close together. Thus, the disclosed dimples are effective at introducing turbulence into the boundary layer.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a generally spherical surface and plurality of dimples separated by a land area formed on the surface, wherein at least one of the dimples comprises:

a plurality of blades, wherein each blade comprises:
- a trailing edge flush with the land area of the golf ball;
- a leading edge;
- a side wall connected to the leading edge, wherein the height of the side wall varies along the leading edge, and wherein the height of the side wall is zero at each end of the side wall;
- a sloped floor extending from the trailing edge to the leading edge;
- a blade tip connecting the leading edge to the trailing edge at a distal end of the blade; and
- a blade root connecting the leading edge to the trailing edge at a proximal end of the blade.

2. The golf ball of claim 1, wherein the sloped floor has a first depth at the trailing edge and a second depth at a connection point between the leading edge and the blade root, wherein the second depth is greater than the first depth.

3. The golf ball of claim 2, wherein the second depth is the largest depth of the dimple in relation to the land area of the golf ball.

4. The golf ball of claim 1, wherein the trailing edge includes a single curvature and the leading edge includes a reflex curvature.

5. The golf ball of claim 1, wherein the leading edge comprises a first portion in which the side wall connects the land area of the golf ball to the sloped floor and a second portion in which the side wall connects the sloped floor to the blade root of an adjacent blade.

6. The golf ball of claim 1, wherein the number of blades in the dimple is in a range inclusive from 3-8.

7. The golf ball of claim 1, wherein the side wall forms an angle of approximately 90 degrees with the land area of the golf ball.

8. The golf ball of claim 1, wherein the leading edge includes a reflex curvature having an inflection point.

9. The golf ball of claim 8, wherein the inflection point is at the midpoint of the side wall.

10. A golf ball comprising a generally spherical surface and plurality of dimples separated by a land area formed on the surface, wherein at least one of the dimples comprises:

a plurality of blades, wherein each blade comprises:
- a trailing edge flush with the land area of the golf ball;
- a leading edge;
- a side wall connected to the leading edge;
- a sloped floor extending from the trailing edge to the leading edge;
- a blade tip connecting the leading edge to the trailing edge at a distal end of the blade; and
- a blade root connecting the leading edge to the trailing edge at a proximal end of the blade, wherein the leading edge of one blade is connected to the trailing edge of an adjacent blade at a connection point and the side wall has a largest height at the connection point, and wherein the connection point is located between the ends of the leading edge and divides the leading edge into a first portion and a second portion.

11. The golf ball of claim 10, wherein the connection point is at the midpoint of the leading edge.

12. A golf ball comprising a generally spherical surface and plurality of dimples separated by a land area formed on the surface, wherein at least one of the dimples comprises:

a plurality of blades, wherein each blade comprises:
- a trailing edge flush with the land area of the golf ball;
- a leading edge;
- a side wall connected to the leading edge;
- a sloped floor extending from the trailing edge to the leading edge;
- a blade tip connecting the leading edge to the trailing edge at a distal end of the blade; and
- a blade root connecting the leading edge to the trailing edge at a proximal end of the blade, the blade root comprising an edge that extends from a base end of the trailing edge to a base end of the leading edge, wherein the blade root of one blade overlaps a portion of the leading edge of another blade.

13. The golf ball of claim 12, wherein the leading edge of one blade is connected to the trailing edge of an adjacent blade at a connection point, and wherein the blade root extends from the connection point to a center of the dimple.

* * * * *